United States Patent [19]

Erickson

[11] 4,093,295

[45] June 6, 1978

[54] BOTTLE CARRIER

[75] Inventor: Gerald Erickson, Palm Beach, Fla.

[73] Assignee: International Omni-Pak Corporation, Surfside, Fla.

[21] Appl. No.: 750,196

[22] Filed: Dec. 13, 1976

Related U.S. Application Data

[63] Continuation of Ser. No. 587,895, Jun. 18, 1975, abandoned, which is a continuation of Ser. No. 462,110, Apr. 18, 1974, abandoned.

[51] Int. Cl.[2] ..... B65D 71/00

[52] U.S. Cl. ..... 294/87.2; 206/150; 206/199; 224/45 AA

[58] Field of Search ..... 294/31.2, 87 R, 87.2, 294/87.22, 87.26, 87.28; 206/139, 145, 150, 151, 159, 161, 162, 168, 194, 199, 201; 215/100 A; 224/45 A, 45 AA, 45 AB, 45 BA; D9/178

[56] References Cited

U.S. PATENT DOCUMENTS

| | | | |
|---|---|---|---|
| 3,003,805 | 10/1961 | Glazer | 294/87.2 |
| 3,036,853 | 5/1962 | Glazer | 294/87.2 |
| 3,608,949 | 9/1971 | Owen | 294/87.2 |
| 3,633,962 | 1/1972 | Erickson | 294/87.2 |

FOREIGN PATENT DOCUMENTS

| | | | |
|---|---|---|---|
| 2,068,858 | 3/1971 | France | 294/87.2 |

*Primary Examiner*—Johnny D. Cherry
*Attorney, Agent, or Firm*—Brumbaugh, Graves, Donohue & Raymond

[57] ABSTRACT

An integrally formed bottle carrier for carrying a row of bottles side by side by their necks in which the bottles are locked into and removed from a plurality of uniformly spaced split collars which are mounted within individual frames interconnected in a single row by one or more longitudinally extending rigid bridging bars.

3 Claims, 10 Drawing Figures

8
9
30
31
32
33
34
35
36
37
37a
38
38a

BOTTLE CARRIER

This application is a continuation of my earlier copending application Ser. No. 587,895 filed June 18, 1975, now abandoned, which, in turn, was a continuation of my prior copending application Ser. No. 462,110, filed Apr. 18, 1974, and now abandoned.

This invention relates to an integrally formed bottle carrier of the type shown and described in my U.S. Pat. No. 3,633,962, issued Jan. 11, 1972, and more particularly to a bottle carrier for carrying a single row of bottles in side by side relation.

As bottles have become larger and heavier there has developed a need for an inexpensive bottle carrier for carrying a relatively small number of bottles in a single row side by side relationship.

The bottle carrier of the present invention fulfills that need by providing a plurality of spaced split collars for receiving and supporting therein the necks of bottles, an individual frame for each split collar to which the split ends as well as other portions of the collar are connected, and means connecting the individual frames in a single row. When the bottles are locked within the bottle carrier they can be readily handled without danger that the bottles will be accidentally released from the carrier.

Figure 1:
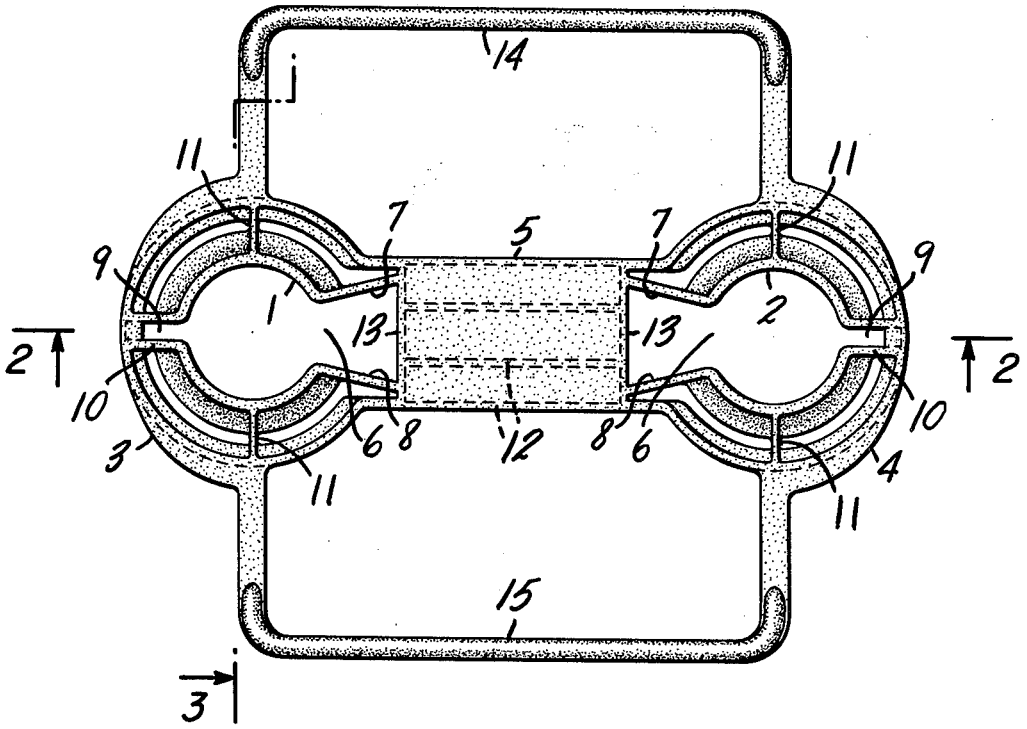
Figure 2:
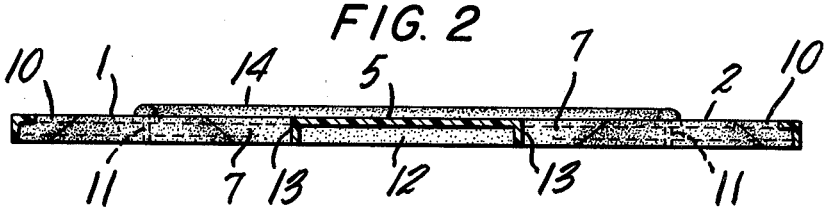
Figure 3:
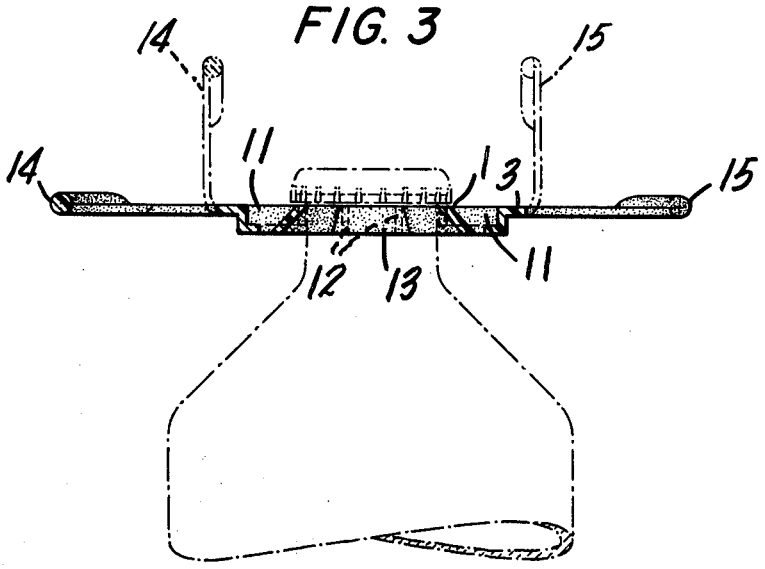
Figure 4:
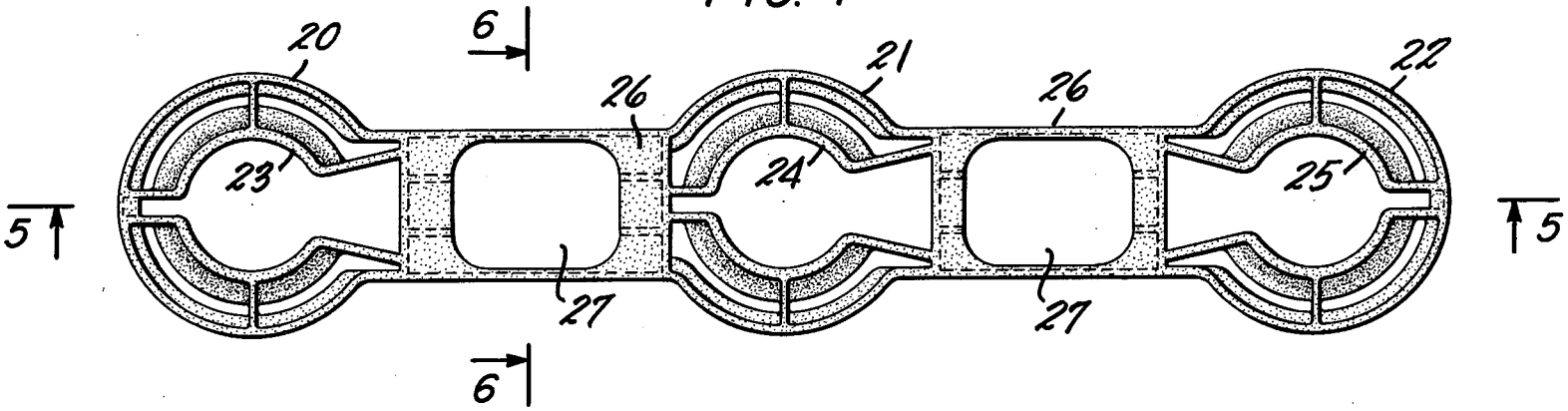
Figure 5:
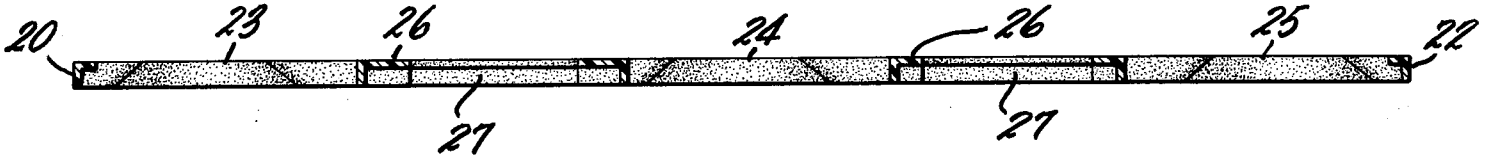
Figure 6:
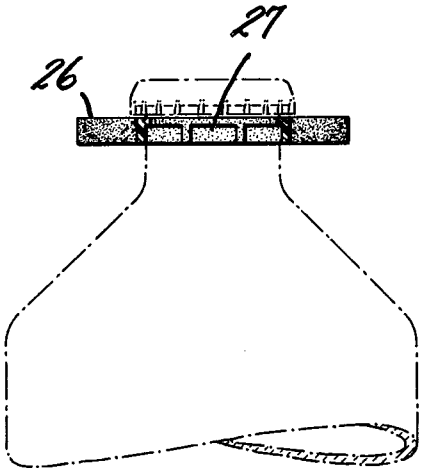
Figures 7, 8, 9, 10:
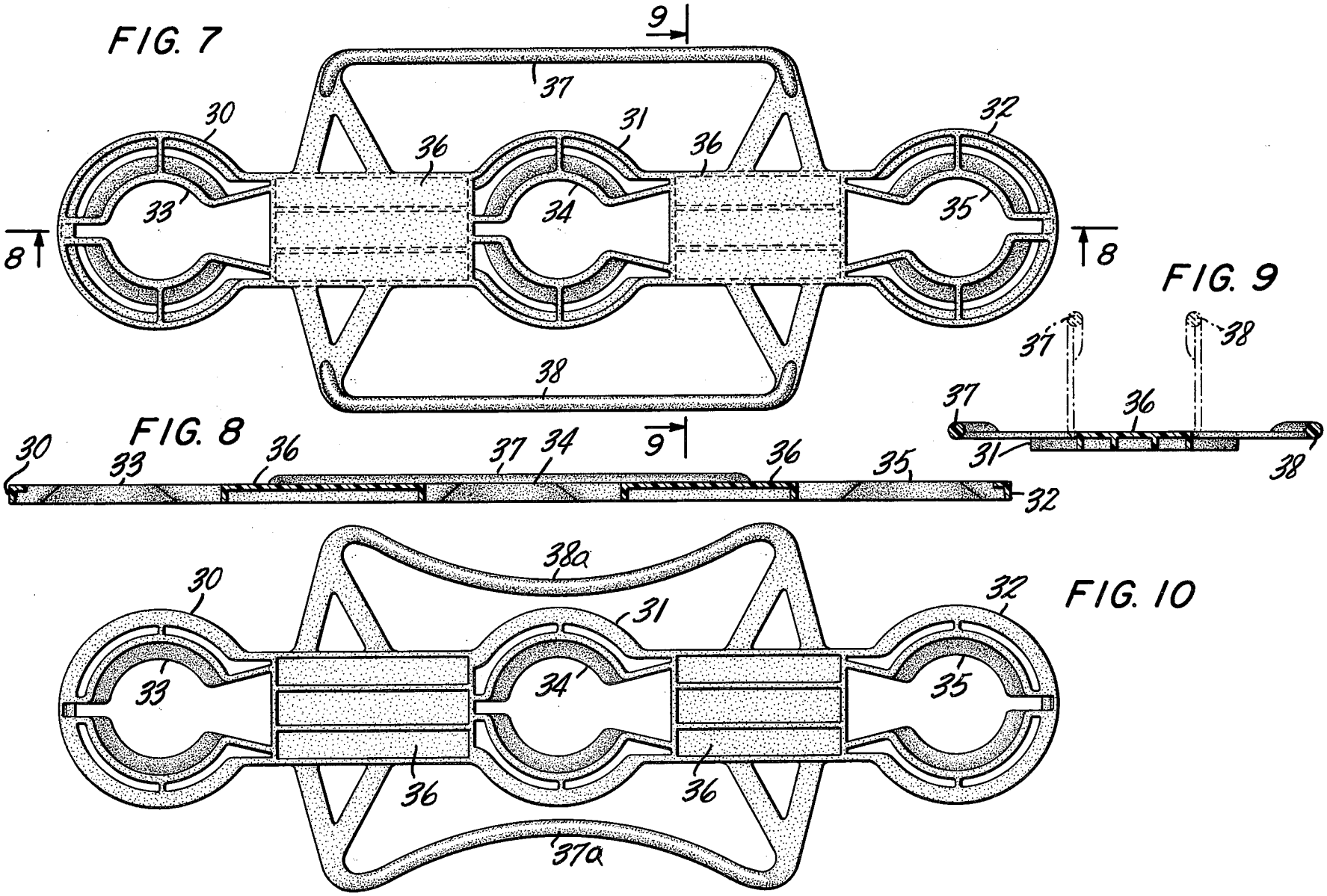

For a complete understanding of the present invention, reference can be made to the detailed description which follows and to the accompanying drawings in which:

FIG. 1 is a plan view of one embodiment of the bottle carrier of the present invention;

FIGS. 2 and 3 are sectional views taken along the lines 2—2 and 3—3, respectively, of FIG. 1 looking in the direction of the arrows;

FIG. 4 is a plan view of another embodiment of the bottle carrier of the present invention;

FIGS. 5 and 6 are sectional views taken along the lines 5—5 and 6—6, respectively, of FIG. 4 looking in the direction of the arrows;

FIG. 7 is a plan view of still another embodiment of the bottle carrier of the present invention;

FIGS. 8 and 9 are sectional views taken along the lines 8—8 and 9—9, respectively, of FIG. 7 looking in the direction of the arrows; and FIG. 10 is a bottom view of still another embodiment of the bottle carrier of the present invention.

Referring to the bottle carrier shown in FIGS. 1 through 3 of the drawings, the bottle carrier includes a pair of split collars 1 and 2 for receiving and supporting therein the necks of bottles, a frame 3 around and spacially separated from the split collar 1, a frame 4 around and spacially separated from the split collar 2 and a longitudinally extending connection 5 bridging the frames 3 and 4 and connecting them in a row.

The split collars 1 and 2, as best shown in FIG. 3, are tapered conical sections, larger at the bottom than at the top, to facilitate the insertion of the bottles therein from the bottom. Each collar is split to provide an enlarged opening 6, and the split ends are connected to the respective frame by a pair of connections 7 and 8 which taper away from each other in the direction from the split ends to the portions of the frame to which they are connected. The ends of the bridging connection 5 form portions of the frames 3 and 4 to which the split ends are connected. The angular relationship of the connections 7 and 8 permits the split collar to be forced open to increase the size of the opening while at the same time providing support for the split collar to prevent it from sagging under the weight of the bottle and offering resistance to accidental spreading of the split collar when it is supporting a bottle therein.

The collar is also split at the opposite end to provide an opening 9 directly opposite the opening 6. This split end is connected to the respective outer frame by connections 10 which cooperate with the outer frame to form a yoke which serves as a pivot for the two components of the collar, thereby facilitating the spreading of the opposite end of the collar for the insertion and removal of a bottle. The collar sections are also supported within the respective frames by a plurality of connections 11.

The bridging connection 5, as shown, is a relatively thin and flat member having a plurality of parallel, longitudinally extending wall formations 12 extending at right angles to one surface of the flat bar to reinforce the bridging connection. A wall formation 13 at each end of the bridge connection 5 forms a leg of each of the frames 3 and 4. The wall formations 12 and 13 are preferably formed on the bottom of the member 5 so that a trademark or advertising matter can be printed on the flat upper surface thereof.

U-shaped handles 14 and 15, molded in the same plane as the bottle carrier, as shown in FIGS. 1 and 2, are connected at opposite ends to the bottle carrier. When gripped and raised they will bend upwardly in side by side relation as shown in phantom in FIG. 3 to facilitate carrying the bottles locked in the carrier.

An embodiment of the bottle carrier of the present invention capable of carrying three bottles in a row is illustrated in FIGS. 4 through 6. In that bottle carrier three frames 20, 21 and 22 accommodating therein, respectively, split collars 23, 24 and 25 are connected in a row by longitudinally extending bridging connections 26. Each of the bridging connections 26 has a finger hole 27 therein to permit the bottle carrier and the bottles locked therein to be grasped between a pair of fingers.

The bottle carrier shown in FIGS. 7 through 9 is also a three bottle carrier having frames 30, 31 and 32 accommodating, respectively, therein split collars 33, 34 and 35 and joined in a row by longitudinally extending bridging connections 36. Oppositely disposed handles 37 and 38 are connected to opposite edges of the bridging connections 36 and normally lie in the same plane as the carrier, as illustrated in FIGS. 7 and 8. When grasped and lifted with bottles locked in the carrier, the handles 37 and 38 will pivot upwardly to the positions shown in phantom in FIG. 9.

The carrier illustrated in FIG. 10 is of the same structure and configuration as the carrier illustrated in FIGS. 7 through 9 except that the handles 37*a* and 38*a* are bowed inwardly to increase their respective lengths so that when they are lifted under the weight of the bottles they will bow upwardly increasing the distance between the gripping hand and upper ends of the bottles.

The bottle carrier of the present invention is preferably molded in one piece of a relatively inexpensive rigid but flexible plastic material, such as polypropylene or linear or high density polyethylene. The bottles will be carried in a row, and the contact between the bottles will tend to hold them in upright positions.

The invention has been shown in preferred forms and by way of example only and many modifications and variations may be made therein without departing from the spirit of the invention. The term "bottle", for example, is intended to apply to containers having necks capable of use in the carrier of the present invention and is not intended to be limited to glass bottles. The invention, therefore, is not to be limited to any specified form or embodiment except in so far as such limitations are expressly set forth in the claims.

I claim:

1. An integrally formed bottle carrier for carrying a single row of bottles comprising a plurality of spaced open-ended collars for receiving and supporting therein the necks of the bottles, a longitudinally extending substantially rigid bridging bar connecting a pair of collars, an individual frame around and spacially separated from each collar and within which the respective collar is mounted, part of said frame forming a reinforcing edge of the adjacent rigid bridging bar, means connecting each collar to the individual frame to lend support thereto, diagonally extending legs connecting the open ends of each collar to the reinforcing edge of the adjacent rigid bridging bar to permit the open ends to be spread apart to receive the neck of a bottle, the extreme opposite of said longitudinally spaced collars in the carrier being oriented with the open ends facing inwardly opposite to each other and toward an adjacent rigid bridging bar to permit removal of either end bottle by pivoting the lower end thereof outwardly away from the adjacent bottle in the carrier, and a plurality of longitudinally extending reinforcing ribs beneath said rigid bridging bar and connecting the portions of the frames which form the opposite reinforced edges of each rigid bridging bar, said bottle carrier being further characterized in that there are at least two longitudinally extending bridging bars connecting at least three frames in a row and in that the open-ended collar intermediate a pair of rigid bridging bars is oriented longitudinally with the open end facing toward the open end of an adjacent collar.

2. An integrally formed bottle carrier for carrying a single row of bottles side by side comprising a discrete longitudinally extending one-piece member formed of resilient plastic material and having a plurality of at least three openings therein spaced longitudinally in a straight line by approximately the widths of the bottles to be carried thereby, a split collar accommodated in each opening with the split portion thereof oriented longitudinally with respect to said longitudinally extending member for receiving and supporting therein the necks of the bottles, the portion of the discrete longitudinally extending member surrounding each opening defining an individual frame spacially separated from each split collar and within which the respective split collar is mounted, each split collar having at least one opening defined by split ends of the collar for receiving the neck of the bottle therebetween, means for connecting the split ends of each collar to the individual frame to lend support to the split ends while permitting them to be spread apart to receive the neck of the bottle, means for connecting other portions of each collar to portions of the individual frame, a longitudinally extending and longitudinally stiffened web-like bridging connection forming part of the discrete longitiduinally extending member between adjacent individual frames connecting the frame in a single longitudinal row, there being at least two longitudinally extending bridging connections connecting at least three frames, the extreme opposite of said longitudinally spaced collars in the carrier being oriented with the split portions thereof facing inwardly opposite to each other and toward an adjacent bridging connection to permit removal of either end bottle by pivoting the lower end thereof longitudinally of the carrier away from the adjacent bottle in the carrier, and a pair of handles initially lying in the same plane as the carrier, one on each side of an edge of the carrier edge, each handle being characterized by a pair of legs having their inner ends formed integrally with the respective edge of the carrier and extending outwardly of said edge of the carrier and an inwardly bowed connection between and integrally formed with the outer ends of the legs so that when the inwardly bowed connections are lifted to lift the bottles in the carrier the inwardly bowed connections will automatically bow upwardly under the weight of the bottles to separate the gripping hand from the tops of the bottles.

3. An integrally formed bottle carrier for carrying a single row of bottles side by side comprising a discrete longitudinally extending one-piece member formed of resilient plastic material and having a plurality of at least three openings therein spaced longitudinally in a straight line by approximately the widths of the bottles to be carried thereby, a split collar accommodated in each opening with the split portion thereof oriented longitudinally with respect to said longitudinally extending member for receiving and supporting therein the necks of the bottles, the portion of the discrete longitudinally extending member surrounding each opening defining an individual frame spacially separated from each split collar and within which the respective split collar is mounted, each split collar having at least one opening defined by split ends of the collar for receiving the neck of the bottle therebetween, means for connecting the split ends of each collar to the individual frame to lend support to the split ends while permitting them to be spread apart to receive the neck of the bottle, means for connecting other portions of each collar to portions of the individual frame, a longitudinally extending and longitudinally stiffened web-like bridging connection forming part of the discrete longitudinally extending member between adjacent individual frames connecting the frames in a single longitudinal row, there being at least two longitudinally extending bridging connections connecting at least three frames, the extreme opposite of said longitudinally spaced collars in the carrier being oriented with the split portions thereof facing inwardly opposite to each other and toward an adjacent bridging connection to permit removal of either end bottle by pivoting the lower end thereof longitudinally of the carrier away from the adjacent bottle in the carrier, and including a pair of oppositely disposed handles initially lying in substantially the same plane as the discrete longitudinally extending member and each connected at opposite ends to the two longitudinally extending bridging connections to enable the oppositely disposed handles to be grasped and bent upwardly in side by side relation while lending support to the carrier without sag, in which the handles are initially bowed inwardly toward the carrier and which tend to bow upward when the handles are lifted.

* * * * *